US006701683B2

(12) United States Patent
Messenger et al.

(10) Patent No.: US 6,701,683 B2
(45) Date of Patent: Mar. 9, 2004

(54) METHOD AND APPARATUS FOR A COMPOSITE CONCRETE PANEL WITH TRANSVERSELY ORIENTED CARBON FIBER REINFORCEMENT

(75) Inventors: Harold G. Messenger, Rehoboth, MA (US); Thomas G. Harmon, St. Louis, MO (US)

(73) Assignee: Oldcastle Precast, Inc., Rehoboth, MA (US)

( * ) Notice: Subject to any disclaimer, the term of this patent is extended or adjusted under 35 U.S.C. 154(b) by 99 days.

(21) Appl. No.: 10/093,292

(22) Filed: Mar. 6, 2002

(65) Prior Publication Data

US 2003/0167715 A1 Sep. 11, 2003

(51) Int. Cl.[7] ..... E04C 5/07

(52) U.S. Cl. ..... 52/309.11; 52/309.12; 52/309.14; 52/309.16; 52/309.17; 52/314; 52/426; 52/794.1; 52/742.14; 52/745.19

(58) Field of Search ..... 52/309.11, 309.12, 52/309.14, 309.16, 309.17, 314, 315, 426, 794.1, 742.14, 745.19

(56) References Cited

U.S. PATENT DOCUMENTS

| | | | | | |
|---|---|---|---|---|---|
| 890,011 | A | | 6/1908 | Anderson | 52/602 X |
| 1,229,904 | A | | 6/1917 | Day | 52/602 X |
| 1,420,246 | A | | 6/1922 | Faber | 52/602 X |
| 1,484,206 | A | | 2/1924 | Birkholz | 52/602 |
| 1,834,892 | A | | 12/1931 | Betzler | 52/602 X |
| 1,891,837 | A | | 12/1932 | Pittman | 52/602 X |
| 1,897,327 | A | | 2/1933 | Olson | 52/602 X |
| 2,080,618 | A | | 5/1937 | Madsen | 52/602 X |
| 2,312,293 | A | | 2/1943 | Weiss | 52/600 X |
| 3,298,152 | A | * | 1/1967 | Lockshaw | |
| 3,305,991 | A | * | 2/1967 | Weismann | |
| 3,567,816 | A | | 3/1971 | Embree | 52/602 X |
| 3,597,890 | A | | 8/1971 | Hala | 52/309.17 |
| 3,646,715 | A | * | 3/1972 | Pope | |
| 3,775,916 | A | * | 12/1973 | Bair | |
| 3,879,908 | A | * | 4/1975 | Weismann | |
| 4,019,297 | A | | 4/1977 | Murphy | 52/309.2 |
| 4,052,825 | A | * | 10/1977 | Larsson | |
| 4,073,998 | A | | 2/1978 | O'Connor | 428/310 |
| 4,104,842 | A | * | 8/1978 | Rockstead et al. | |
| 4,125,981 | A | * | 11/1978 | MacLeod et al. | |
| 4,229,497 | A | | 10/1980 | Piazza | 52/309.12 X |
| 4,233,787 | A | | 11/1980 | Piazza | 52/602 X |
| 4,505,019 | A | * | 3/1985 | Deinzer | |
| 4,611,450 | A | * | 9/1986 | Chen | |
| 4,612,748 | A | | 9/1986 | Arnold et al. | 52/600 X |
| 4,617,219 | A | | 10/1986 | Shupack | 52/782.1 X |
| 4,706,430 | A | * | 11/1987 | Sugita et al. | |
| 4,841,702 | A | | 6/1989 | Huettemann | 52/309.12 |
| 4,912,902 | A | * | 4/1990 | Weaver | |
| 4,916,004 | A | | 4/1990 | Ensminger et al. | 428/192 |
| 4,934,121 | A | | 6/1990 | Zimmerman | 52/602 X |
| 5,025,605 | A | * | 6/1991 | Sekijima et al. | |
| 5,032,340 | A | | 7/1991 | Akihama et al. | 264/258 |
| 5,058,345 | A | * | 10/1991 | Martinez | |
| 5,095,674 | A | | 3/1992 | Huettemann | 52/309.11 X |
| 5,146,721 | A | * | 9/1992 | Candiracci | |

(List continued on next page.)

FOREIGN PATENT DOCUMENTS

| | | | | |
|---|---|---|---|---|
| AU | 114294 | | 12/1941 | 52/602 |
| EP | 16478 | | 10/1980 | 52/602 |
| EP | 0 227 207 | * | 1/1987 | E04C/5/07 |
| GB | 545526 | | 6/1942 | 52/602 |
| GB | 2201175 | | 8/1988 | 52/630 |

*Primary Examiner*—Robert Canfield
(74) *Attorney, Agent, or Firm*—Sheridan Ross P.C.

(57) ABSTRACT

The present invention relates to building panels used in the construction industry, and more specifically composite building panels comprised of an insulative core, concrete, and carbon fiber which are preformed, cast and transported to a building site for modular construction.

25 Claims, 4 Drawing Sheets

U.S. PATENT DOCUMENTS

| | | | | | |
|---|---|---|---|---|---|
| 5,317,848 | A | | 6/1994 | Abbey | 52/630 X |
| 5,398,470 | A | * | 3/1995 | Ritter et al. | |
| 5,493,836 | A | | 2/1996 | Lopez-Muñoz | 52/602 |
| 5,493,838 | A | | 2/1996 | Ross | 52/745.1 |
| 5,758,463 | A | | 6/1998 | Mancini, Jr. | 52/309.12 |
| 5,836,715 | A | | 11/1998 | Hendrix et al. | 404/134 |
| D406,902 | S | | 3/1999 | Lockwood | D25/1 |
| 5,894,003 | A | | 4/1999 | Lockwood | 264/36.19 |
| D426,321 | S | | 6/2000 | Lockwood | D25/138 |
| 6,088,985 | A | | 7/2000 | Clark | 52/309.11 |
| 6,094,881 | A | | 8/2000 | Lockwood | 52/731.2 |
| 6,164,035 | A | | 12/2000 | Roberts | 52/563 |
| 6,202,375 | B1 | | 3/2001 | Kleinschmidt | 52/309.11 |
| 6,230,465 | B1 | | 5/2001 | Messenger et al. | 52/630 |
| 6,237,297 | B1 | * | 5/2001 | Paroly | |
| 6,263,629 | B1 | * | 7/2001 | Brown | |
| 6,272,805 | B1 | * | 8/2001 | Ritter et al. | |
| 6,345,483 | B1 | * | 2/2002 | Clark | |
| 2001/0010140 | A1 | * | 8/2001 | Ritter et al. | |
| 2003/0029107 | A1 | * | 2/2003 | Ritter et al. | |

* cited by examiner

METHOD AND APPARATUS FOR A COMPOSITE CONCRETE PANEL WITH TRANSVERSELY ORIENTED CARBON FIBER REINFORCEMENT

FIELD OF THE INVENTION

The present invention relates to building materials, and more specifically composite lightweight building panels which can be interconnected to build structures such as modular buildings.

BACKGROUND OF THE INVENTION

Due to the high cost of traditional building materials and the extensive transportation and labor costs associated therein, there is a significant need in the construction industry to provide a lightweight, precast, composite building panel which may be transported to a building site and assembled to provide a structure with superior strength and insulative properties. Previous attempts to provide these types of materials have failed due to the extensive transportation costs and the low insulative values associated with prefabricated concrete and wire products. Further, due to the brittle nature of concrete, many of these types of building panels become cracked and damaged during transportation.

More specifically, the relatively large weight per square foot of previous building panels has resulted in high expenses arising not only from the amount of materials needed for fabrication, but also the cost of transporting and erecting the modules. Module weight also placed effective limits on the height of structures, such as stacked modules, e.g. due to limitations on the total weight carried by the lowermost modules. Furthermore, there is substantial fabrication labor expense that can arise from efforts needed to position, design and construct molds, and the materials and labor costs involved in providing and placing reinforcement materials. Accordingly, it would be useful to provide a system for modular construction which is relatively light, can be readily stacked to heights greater than in previous configurations and, preferably, inexpensive to design and use.

Further, in many situations panels or modules are situated in locations where it is desirable to have openings therethrough to accommodate doorways, windows, cables, pipes and the like. In some previous approaches, panels were required to be specially designed and cast so as to include any necessary openings, requiring careful planning and design and increasing costs due to the special, non-standard configuration of such panels. In other approaches, panels were cast without such openings and the openings were formed after casting e.g. by drilling or similar procedures. Such post-casting procedures as drilling, particularly through the relatively thick and/or steel-reinforced panels as described above, was a relatively labor-intensive and expensive process. In many processes for creating openings, there was a relatively high potential for cracking or splitting of a panel or module. Accordingly, it would be useful to provide a module which can be easily provided with openings such as doors and windows in desired locations and with a reduced potential for cracking or splitting.

One example of a composite building panel which attempts to resolve these problems with modular panel construction is described in U.S. Pat. No. 6,202,375 to Kleinschmidt (the '375 patent). In this invention, a building system is provided which utilizes an insulative core with an interior and exterior sheet of concrete and which is held together with a metallic wire mesh positioned on both sides of an insulative core. The wire mesh is embedded in concrete, and held together by a plurality of metallic wires extending through said insulative core at a right angle to the longitudinal plane of the insulative core and concrete panels. Although providing an advantage over homogenous concrete panels, the composite panel disclosed in the '375 patent does not provide the necessary strength and flexure properties required during transportation and high wind applications. Further, the metallic wire mesh materials are susceptible to corrosion when exposed to water during fabrication, and have poor insulative qualities due to the high heat transfer qualities of metallic wire. Thus, the panels disclosed in the '375 patent may eventually fail when various stresses are applied to the building panel during transportation, assembly or subsequent use. Furthermore, these panels have poor insulative qualities in cold climates due to the high heat transfer associated with the metallic wires.

Other attempts have been made to use improved building materials that incorporate carbon fiber. One example is described in U.S. Pat. No. 6,230,465 to Messenger, et al. which utilizes carbon fiber in combination with a steel reinforced precast frame with concrete. Unfortunately, the insulative properties are relatively poor due to the physical nature of the concrete and steel, as well as the excessive weight and inherent problems associated with transportation, stacking, etc.

Accordingly, there is a significant need in the construction and building industry to provide a composite building panel which may be used in modular construction and which is lightweight, provides superior strength and has high insulative values. Further, a method of making these types of building panels is needed which is inexpensive, utilizes commonly known manufacturing equipment, and which can be used to mass produce building panels for use in the modular construction of temporary shelters, permanent housing, hotels, and other buildings.

SUMMARY OF THE INVENTION

It is thus one aspect of the present invention to provide a composite wall panel which has superior strength, high insulating properties, is lightweight for transportation and stacking purposes and is cost effective to manufacture. Thus, in one embodiment of the present invention, a substantially planar insulative core with interior and exterior surfaces is positioned between concrete panels which are reinforced with carbon fiber grids positioned substantially adjacent the insulative core and which is interconnected to a plurality of diagonal carbon fiber strands. In a preferred embodiment of the present invention, the interior layer of concrete is comprised of a low-density concrete.

It is yet another aspect of the present invention to provide a superior strength composite wall panel which utilizes carbon fiber materials which are oriented in a novel geometric configuration which interconnects the insulative core and both the interior and exterior concrete panels. In one embodiment of the present invention, a plurality of carbon fibers are oriented in a substantially diagonal orientation through the insulative core and which are operably interconnected to carbon fiber mesh grids positioned proximate to the interior and exterior surfaces of the insulative core and which operably interconnect both the interior and exterior concrete panels to the insulative core. Preferably, the carbon fiber mesh grid is comprised of a plurality of first carbon fiber strands extending in a first direction which are operably interconnected to a plurality of second carbon fiber strands oriented in a second direction. Preferably, the carbon fiber mesh grids are embedded within the interior and exterior concrete panels.

It is a further aspect of the present invention to provide a composite wall panel with an insulative core which has superior compressive strength and which utilizes STYROFOAM®, a ridged, light-weight expanded polystyrene ("EPS") material, or other similar materials. Thus, in another aspect of the present invention, a plurality of anti-compression pins are placed throughout the insulative core and which extend substantially between the interior and exterior surfaces of the insulative core. Preferably, these pins are comprised of ceramic, fiberglass, carbon-fiber or other materials which are resistant to compression and do not readily transfer heat.

It is another aspect of the present invention to provide a composite wall panel which can be easily modified to accept any number of exterior textures, surfaces or cladding materials for use in a plurality of applications. Thus, the present invention is capable of being finished with a brick surface, stucco, siding and any other type of exterior surface. In one embodiment of the present invention, a paraffin protective covering is provided on the exterior surface for protection of the exterior surface during manufacturing. The paraffin additionally prevents an excessive bond between the individual bricks and exterior concrete wall to allow the removal of a cracked or damaged brick and additionally has been found to reduce cracking in the bricks due to the differential shrinkage of the exterior concrete layer and clay brick. Furthermore, other types of materials such as drywall and other interior finishes can be applied to the interior concrete panel as necessary for any given application.

It is yet a further aspect of the present invention to provide a novel brick configuration which allows broken or cracked bricks to be quickly and effectively replaced. Thus, in one embodiment of the present invention a beveled brick design is provided wherein a rear portion of the brick has a greater diameter than a front end, and is embedded into the exterior concrete layer during the forming process. This design provides superior strength, and allows a damaged brick to be chiseled free and quickly replaced with a new brick by applying a glue or epoxy material.

It is yet another aspect of the present invention to provide a composite modular wall panel which can be used to quickly and efficiently construct modular buildings and temporary shelters and is designed to be completely functional with regard to electrical wiring and other utilities such as telephone lines, etc. Thus, the present invention in one embodiment includes at least one utility line which may be positioned at least partially within the composite wall panel and which accepts substantially any type of utility line which may be required in residential or commercial construction, and which can be quickly interconnected to exterior service lines. This utility line may be oriented in one or more directions and positioned either near the interior concrete panel, exterior concrete panel, or both.

Thus, in one embodiment of the present invention, a composite wall panel is provided which comprises:

an insulative core having an interior surface and an exterior surface;

a substantially impermeable vapor barrier positioned adjacent to said insulative core;

a first carbon fiber grid positioned proximate to said exterior surface of said insulative core and comprising a plurality of first carbon fibers oriented in a first direction which are operably interconnected to a plurality of second carbon fibers oriented in a second direction;

a second carbon fiber grid positioned proximate to said interior surface of said insulative core and comprising a plurality of first carbon fibers oriented in a first direction which are operably interconnected to a plurality of second carbon fibers oriented in a second direction;

a plurality of carbon fiber strands operably interconnecting said first carbon fiber grid and said second carbon fiber grid and extending through said insulative core in a substantially diagonal orientation;

an exterior layer of concrete positioned substantially adjacent to said exterior surface of said insulative core;

an interior layer of concrete positioned substantially adjacent to said interior surface of said insulative core, wherein said insulative core, said exterior layer of concrete, said interior layer of concrete, said first carbon fiber grid and said second carbon fiber grid are operably interconnected with said plurality of carbon fiber strands.

DETAILED DESCRIPTION

Figure 1:
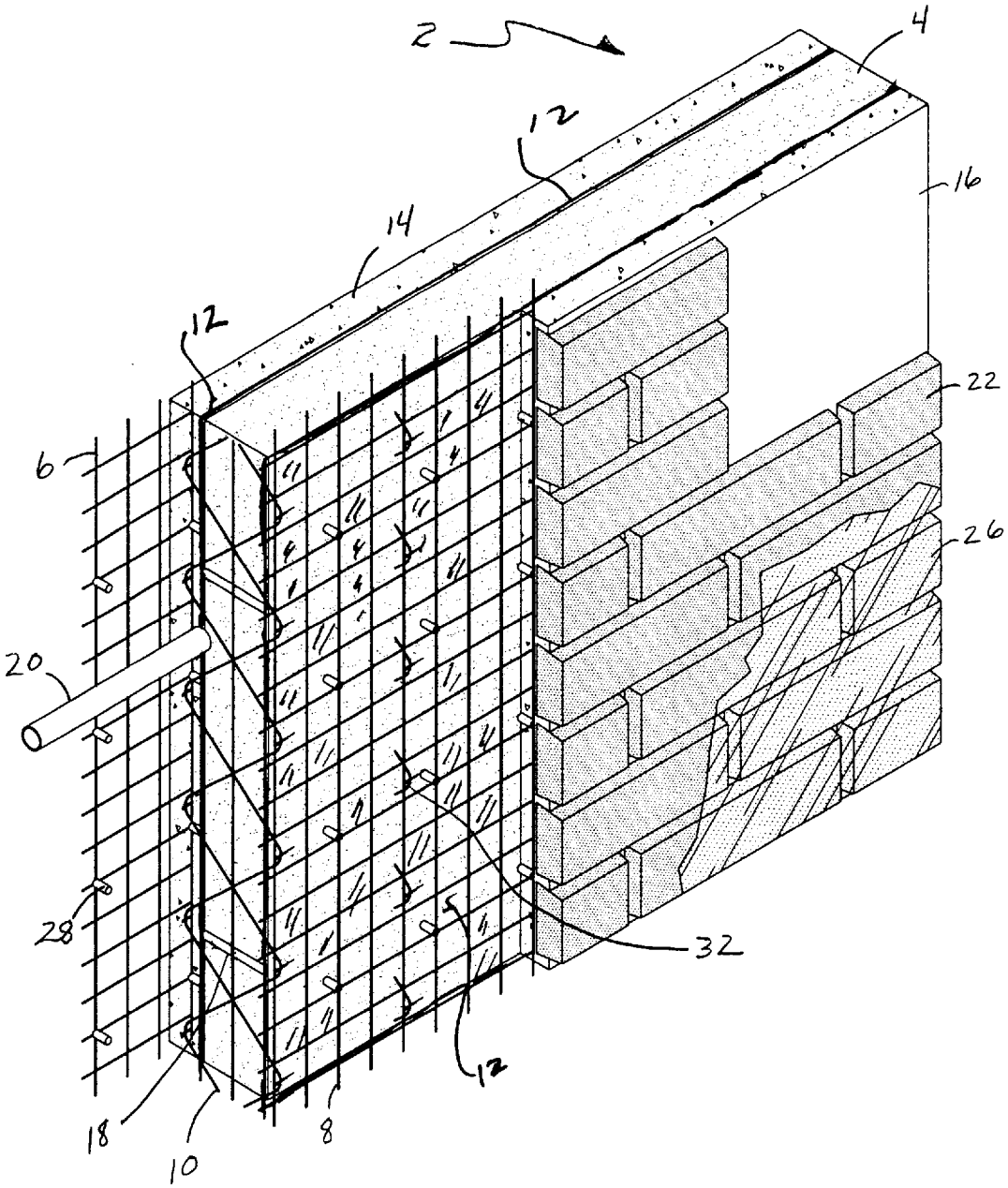
FIG. 1 is a front perspective view of a composite building panel which represents one embodiment of the present invention.

Referring now to the drawings, FIG. 1 is a front perspective view of one embodiment of the present invention and which generally identifies a novel composite building panel 2. The building panel 2 is generally comprised of an insulative core 4 which has an interior and exterior surface and a substantially longitudinal plane extending from a lower portion to an upper portion of said insulative core 4. The interior surface of the insulative core 4 is positioned immediately adjacent an interior concrete layer 14, while the exterior layer of the insulative core 4 is positioned substantially adjacent an exterior concrete layer 16. An interior carbon fiber grid 6 and an exterior carbon fiber grid 8 are additionally positioned substantially adjacent the interior and exterior surfaces of the insulative core 4, respectively, and which are preferably embedded within the interior concrete layer 14 and the exterior concrete layer 16. These carbon fiber grids are connected to a plurality of carbon fiber strands 10 which are oriented in a substantially diagonal configuration with respect to the longitudinal plane of the insulative core 4. The plurality of carbon fiber strands extend from the exterior concrete carbon fiber grid 8 through the insulative core 4 and are interconnected to the interior carbon fiber grid 6 on the opposing side. To assure proper spacing of the interior carbon fiber grid 6 and exterior carbon fiber grid 8, a plurality of spacers 28 may be employed in one embodiment of the present invention. Additionally, plastic or metallic connector clips 32 are preferably used to interconnect the carbon fiber strands 10 to the interior carbon fiber grid 6 and exterior carbon fiber grid 8.

As further identified in FIG. 1, in one embodiment of the present invention a utility conduit 20 is provided which is at least partially embedded in the insulative core 4 while partially embedded in the interior concrete layer 14 and which is used to contain electrical wiring, cabling, telephone wiring, and other types of utility lines commonly used in the construction of interior walls and building panels. The conduit is preferably comprised of a PVC plastic based on the cost, flexibility and low heat transfer properties, but as appreciated by one skilled in the art may also be a clad metal, fiberglass, or other materials. Furthermore, the utility conduit 20 may be positioned in the center of the insulative core 4, within the exterior concrete layer 16 or interior concrete layer 14, or may be oriented in a vertical as well as horizontal direction.

Figure 2:
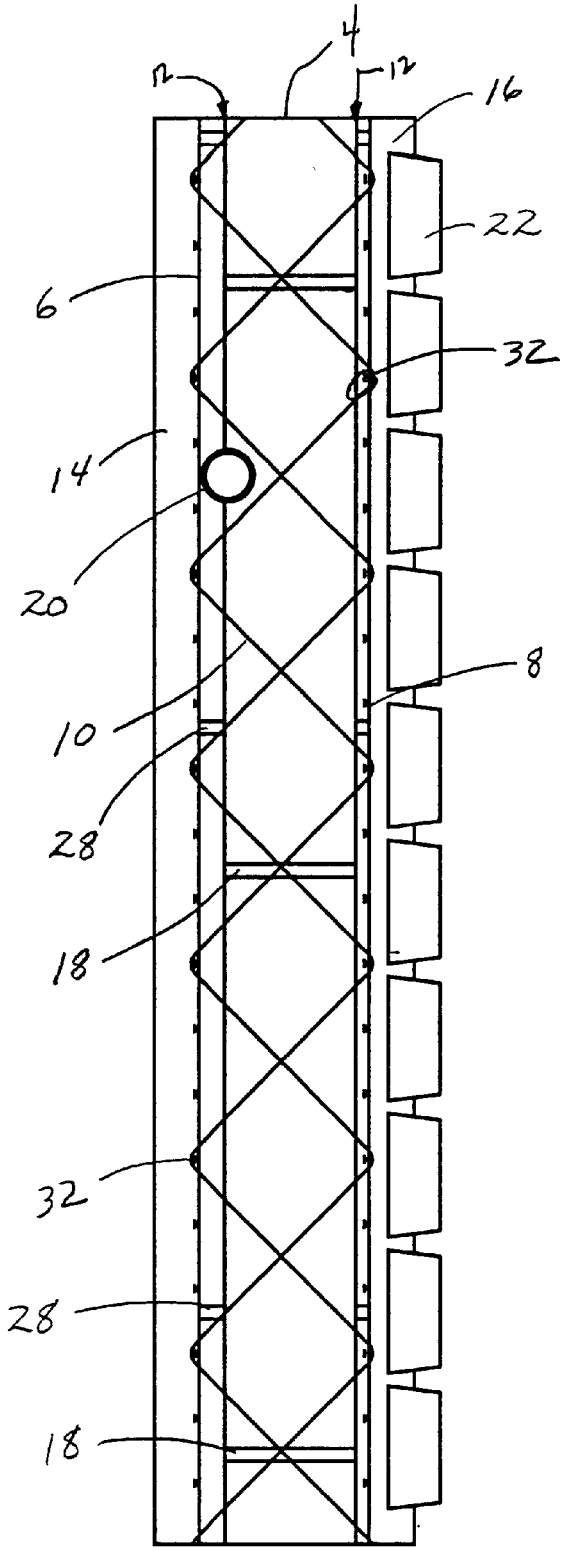
FIG. 2 is a left elevation view of the embodiment shown in FIG. 1.
Figure 3:
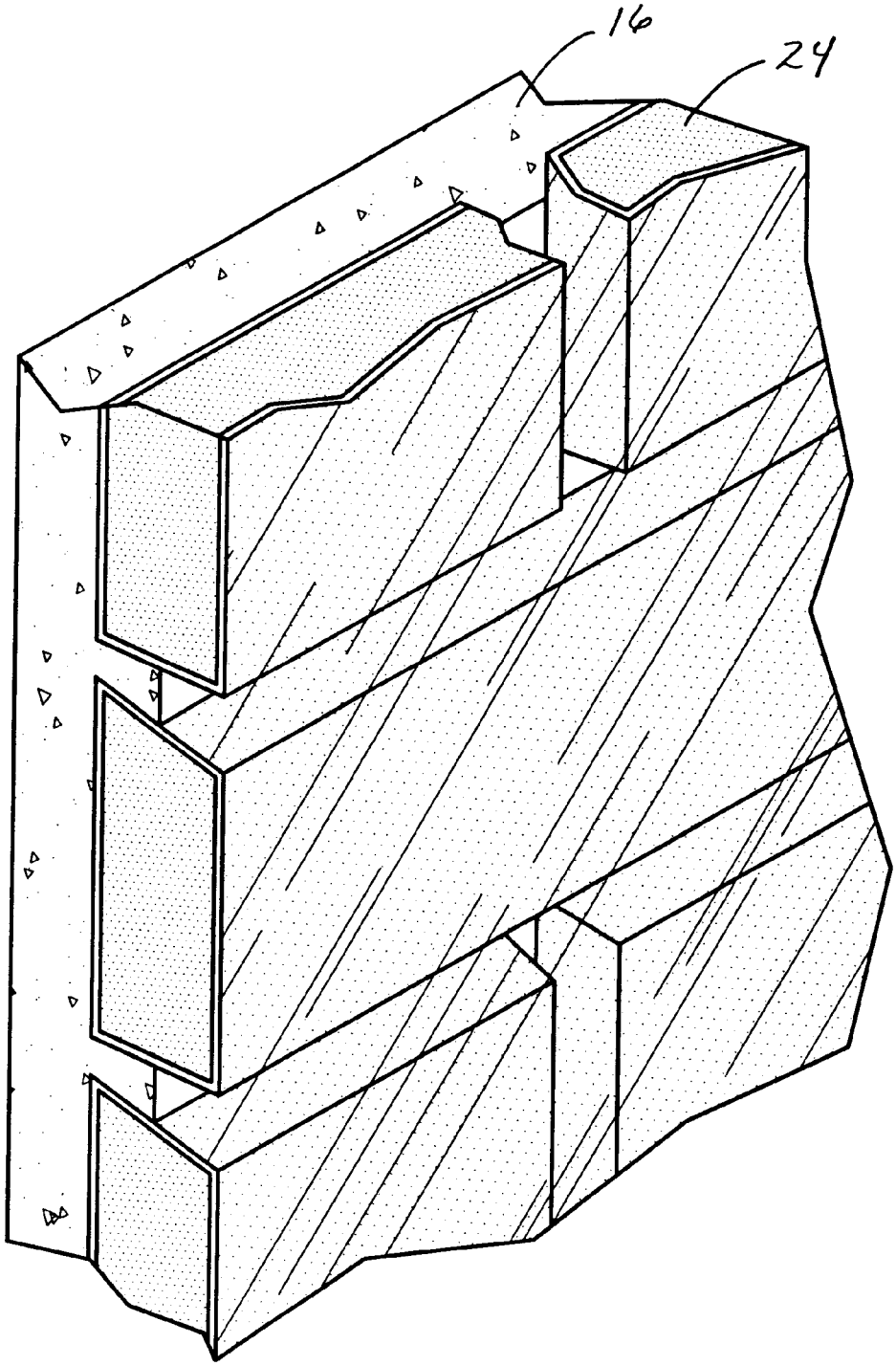
FIG. 3 is a front perspective view identifying an outer concrete layer and a novel brick cladding material embedded therein.

As additionally shown in FIGS. 1–3, an exterior cladding material 22 is provided which may comprise a plurality of bricks 24. Alternatively, stucco, vinyl or wood siding may additionally be used as well as other materials commonly known in the construction industry. Additionally, when a plurality of bricks 24 are employed, a paraffin protective coating material 26 may be applied on the exterior surface of the bricks 24 prior to placement and casting. Upon completion of casting of the modular panel, the paraffin coating 26 or other protective coating may be removed by hot steam to provide a clean surface.

In another embodiment of the present invention, a plurality of compression pins 18 may be positioned throughout the insulative core 4 to provide additional compressive strength to the composite panel 2. Thus, as identified in FIGS. 1 and 2, the compression pins 18 are generally positioned at right angles to the longitudinal plane of the substantially planar insulative core 4, and may be comprised of plastic, fiberglass, or other materials which are resistant to compression and have low heat transfer properties and are not susceptible to corrosion and rust when exposed to water. In one embodiment, the compression pins are comprised of a plastic PVC material having a length based on the thickness of the insulative core 4, and which is generally between about 1.5 inches and 3 inches and a diameter of between about 0.25 inches to 1 inch. Referring now to FIG. 2, a left elevation end view is provided of the panel shown in FIG. 1, and which provides additional detail regarding the various components utilized in the composite wall panel 2. As depicted, the central portion of the composite wall panel 2 comprises an insulative core 4. This insulative core 4 is generally comprised of an expanded polystyrene, such as STYROFOAM®, or other similar lightweight material and has a width of between about 1 to 4 inches, and more preferably about 2.5 inches. As appreciated by one skilled in the art, the thickness of the insulative core 4 is dependent upon the specifications of the building structure and the application for use, including outside air temperature, building height, anticipated wind forces, etc. Further, a vapor barrier 12 may be applied to an interior or exterior surface of the insulative core 4 to substantially prevent any moisture from penetrating the composite wall panel 2.

Figure 4:
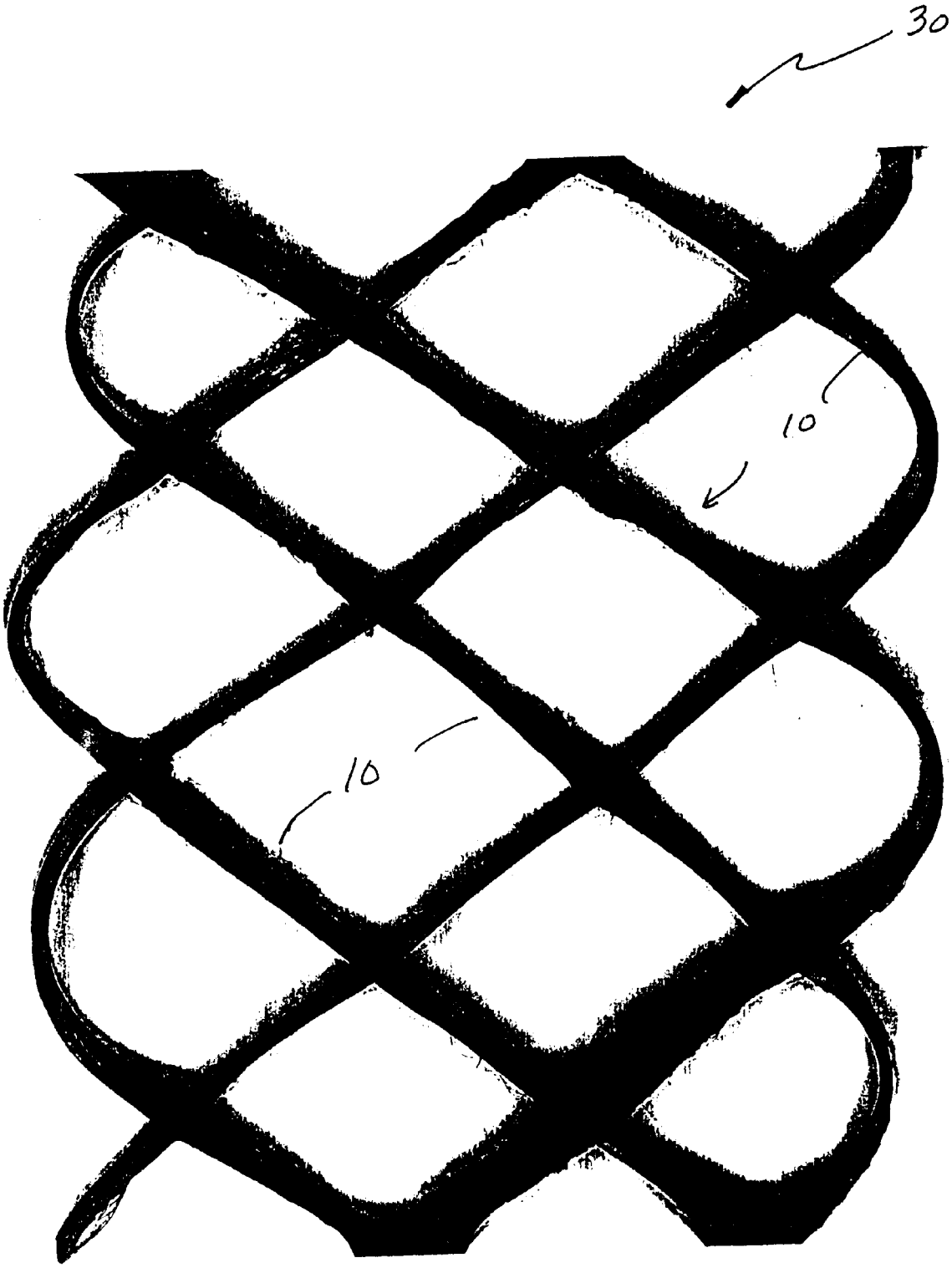
FIG. 4 is a top plan view of one embodiment of a carbon fiber tape which is positioned within an insulative core of the composite building panel of the present invention.

In one embodiment of the present invention, the insulative core 4 is manufactured in a unique process with a plurality of carbon fibers strands 10 positioned in a ribbon/tape pattern 30 which extends through the insulative core 4 and which protrudes beyond both the interior and exterior surfaces to accommodate interconnection to the interior and exterior carbon fiber grids. A depiction of one embodiment of the carbon fiber strands 10 and their orientation and interconnection may be seen in FIG. 4. These carbon fiber strands 10 generally have a thickness of between about 0.05 inches to 0.4 inch, and more preferably a diameter of about 0.15 inches. As more typically referred to in the art, the carbon fiber strands 10 have a given "tow" size. The tow is the number of carbon strands, and may be in the example between about 12,000–48,000 individual strands, i.e., 12K to 48K tow. The intersection points of the carbon fiber strands which are required to make the tape pattern are interconnected with a strong resin such as a thermoset which si applied under a predetermined heat and pressure. In another embodiment, the individual strands of carbon fiber may be "woven" with other strands to create a stronger ribbon/tape material 30.

As shown in FIG. 2, the carbon fiber strands 10 are interconnected to the interior carbon fiber grid 6 positioned substantially adjacent to the interior surface of the insulative core and with the exterior carbon fiber grid 8 positioned substantially adjacent the exterior surface of the insulative core 4. One example of a carbon fiber grid ribbon 30 which may be used in the present invention is the "MeC-GRID™" carbon fiber material which is manufactured by Hexcel Clark-Schwebel. The interior and exterior carbon grid tape is comprised generally of looped weft and warped strands, that run substantially perpendicular to each other and are machine placed on several main tape "stabilizing strands" that run parallel to the running/rolling direction of the tape. The carbon fiber tape is then used in a totally separate process by casting it transversely through the insulating core 4, to produce an insulated structural core panel that links together compositively the interior concrete layer 14 and exterior concrete layer 16 of the composite wall panel 2.

During manufacturing, the insulative core 4 is thus interconnected to the interior carbon fiber grid 6 and exterior carbon fiber grid 8 and the utility conduit 20 is placed in position along with any of the compression pins 18, and other spacers 28, to assure the proper positioning of the wall panel components prior to pouring the interior concrete layer 14 or exterior concrete layer 16. The insulative core 4 is then positioned in a form, wherein the interior concrete layer 14 is poured as well as the exterior concrete layer 16 as necessary. Once the interior and exterior concrete layers are cured and set, the composite wall panel 2 is removed from the form and is subsequently ready for transportation. Alternatively exterior cladding materials 22 such as bricks may be positioned prior to pouring the exterior concrete layer 16 to allow the bricks 24 to be integrally interconnected to the concrete.

Referring now to FIG. 3, a front perspective view of one embodiment of the present invention is shown herein, wherein an exterior cladding material 22 of brick 24 is shown embedded in the exterior concrete layer 16. In this particular embodiment the plurality of bricks 24 are embedded into the exterior concrete layer 16 to provide a finished look and which may include a variety of other materials such as stucco, vinyl siding, and others as previously discussed. In a preferred embodiment, the outermost optional cladding layer is placed on the casting form face down during the manufacturing process and which may additionally be made of tile, brick slips, exposed aggregate or a multitude of other exterior finish components as is required. The exterior cladding 22 typically adds ⅜ to ⅝ inch to the overall wall thickness and must be able to withstand moisture and water penetration, ultraviolet and sunlight exposure, and a full range of potentially extreme surface temperature changes as well as physical abuse, all without the danger of deterioration or delamination of the exterior cladding material 22 from the exterior concrete layer 16.

In a preferred embodiment of the present invention, the bricks 24 are provided with a rear end having a greater diameter than a forward end, and thus creating a trapezoidal type profile as shown in FIG. 2 and 3. By utilizing this shape of brick 24, the bricks are integrally secured to the exterior concrete layer 16. Further, if one or more bricks become damaged or chipped during manufacturing or transportation, they may be chiseled out and a replacement brick glued in its place with an epoxy or other type of glue commonly known in the art.

With regard to the concrete utilized in various embodiments of the present application, the interior wall is preferably comprised of a low density concrete such as Cret-o-Lite™, which is manufactured by Advanced Materials Company of Hamburg, N.Y. This is an air dried cellular concrete which is nailable, drillable, screwable, sawable and very fire resistant. In a preferred embodiment, the exterior concrete layer 16 is comprised of a dense concrete material to resist moisture penetration and in one embodiment is created using VISCO CRETE™ which is a chemical that enables the high slumped short pot life liquification of concrete to enable the concrete to be placed in narrow wall cavities with minimum vibration and thus create a high density substantially impermeable concrete layer. This chemical is manufactured by the Sika Corporation, located in Lyndhurst, N.J. The exterior concrete layer 16 is preferably about ¾ to 2 inches thick, and more preferably about 1.25 inches thick. This concrete layer has a compression strength of approximately 5000 psi after 28 days of curing, and is thus extremely weather resistant.

In a preferred embodiment of the present invention, a vapor barrier material 12 may be positioned next to the exterior surface of the insulative core 4, or alternatively on the interior surface of the insulative foam core 4. The vapor barrier 12 impedes the penetration of moisture and thus protects the foam core from harsh environmental conditions. Preferably, the vapor barrier 12 is comprised of a plastic sheet material, or other substantially impermeable materials that may be applied to the insulative core 4 during manufacturing of the foam core, or alternatively applied after manufacturing and prior to the pouring of the exterior concrete layer 16.

To assist in the understanding of the present invention, the following is a list of the components identified in the drawings and the numbering associated therewith:

| # | Component |
|---|---|
| 2 | Composite building panel |
| 4 | Insulative core |
| 6 | Interior carbon fiber grid |
| 8 | Exterior carbon fiber grid |
| 10 | Carbon fiber strands |
| 12 | Vapor barrier |
| 14 | Interior concrete layer |
| 16 | Exterior concrete layer |
| 18 | Compression pins |
| 20 | Utility conduit |
| 22 | Exterior cladding |
| 24 | Bricks |
| 26 | Paraffin Coating |
| 28 | Spacers |
| 30 | Carbon fiber ribbon/tape |
| 32 | Connector clip |

The foregoing description of the present invention has been presented for purposes of illustration and description. Furthermore, the description is not intended to limit the invention to the form disclosed herein. Consequently, variations and modifications commenced here with the above teachings and the skill or knowledge of the relevant art are within the scope in the present invention. The embodiments described herein above are further extended to explain best modes known for practicing the invention and to enable others skilled in the art to utilize the invention in such, or other, embodiments or various modifications required by the particular applications or uses of present invention. It is intended that the dependent claims be construed to include all possible embodiments to the extent permitted by the prior art.

What is claimed is:

1. A composite building panel, comprising:

an insulative core having an outer surface and an inner surface;

an exterior layer of concrete positioned substantially adjacent said outer surface of said insulative core;

an interior layer of concrete positioned substantially adjacent said inner surface of said insulative core;

a plurality of carbon fiber strands extending in a substantially diagonal pattern between said exterior layer of concrete, through said insulative core, and said interior layer of concrete; and an interior carbon fiber grid positioned proximate to said inner surface of said insulative core and at least partially interconnected to said plurality of carbon fiber strands, and an exterior carbon fiber grid positioned proximate to said outer surface of said insulative core and at least partially interconnected to said plurality of carbon fiber strands.

2. The composite building panel of claim 1, further comprising a plurality of compression pins extending between said outer surface and said inner surface of said insulative core, wherein said compressive strength of said composite building panel is increased.

3. The composite building panel of claim 2, wherein said plurality of compression pins are comprised of at least one of a plastic, a composite and a fiberglass material.

4. The composite building panel of claim 2, wherein said composite building panel has a compressive strength of at least about 40 psi when a force is applied in a direction substantially normal to a longitudinal plane of said building panel.

5. The composite building panel of claim 1, wherein said plurality of carbon fiber strands are oriented at an angle of at least about 35 degrees with respect to a vertical longitudinal plane of said composite building panel.

6. The composite building panel of claim 1, further comprising at least one utility conduit extending through at least a portion of said insulative core which is adapted for receiving a utility line.

7. The composite building panel of claim 6, wherein said at least one utility conduit is comprised of at least one of a plastic, a metal, a vinyl clad metal and a fiberglass.

8. The composite building panel of claim 1, further comprising a cladding material positioned substantially adjacent to said exterior layer of concrete.

9. The composite building panel of claim 8, wherein said cladding material comprises a plurality of bricks having a substantially trapezoidal shape.

10. The composite building panel of claim 8, further comprising a protective layer of paraffin applied to an exterior surface of said cladding material.

11. The composite building panel of claim 1, further comprising a substantially impermeable vapor barrier positioned adjacent to said insulative core.

12. The composite building panel of claim 11, wherein said substantially impermeable vapor barrier comprises a plastic material.

13. The composite building panel of claim 1, wherein said insulative core is comprised of an expanded polystyrene material.

14. A composite building panel adapted for constructing a modular structure, comprising:

an insulative core having an interior surface and an exterior surface;

a substantially impermeable vapor barrier positioned adjacent to said exterior surface of said insulative core;

a first carbon fiber grid positioned proximate to said exterior surface of said insulative core comprising a plurality of first carbon fibers oriented in a first direction which are operably interconnected to a plurality of second carbon fibers oriented in a second direction;

a second carbon fiber grid positioned proximate to said interior surface of said insulative core comprising a plurality of first carbon fibers oriented in a first direction which are operably interconnected to a plurality of second carbon fibers oriented in a second direction;

a plurality of carbon fiber strands interconnecting said first carbon fiber grid and said second carbon fiber grid and extending through said insulative core in a substantially diagonal orientation;

an exterior layer of concrete positioned substantially adjacent to said exterior surface of said insulative core;

an interior layer of concrete positioned substantially adjacent to said interior surface of said insulative core, wherein said insulative core, said exterior layer of concrete, said interior layer of concrete, said first carbon fiber grid and said second carbon fiber grid are interconnected with said plurality of carbon fiber strands.

15. The composite building panel of claim 14, further comprising a plurality of compression pins extending between said interior surface and said exterior surface of said insulative core, wherein said compressive strength of said insulative core is increased.

16. The composite building panel of claim 14, wherein said interior layer of concrete has a density of no greater than about 90 pounds per cubic foot.

17. The composite building panel of claim 14, further comprising at least one utility conduit positioned at least partially in said insulative core which is adapted for receiving a service wire or cable.

18. The composite building panel of claim 14, wherein said first carbon fiber grid is substantially embedded in said exterior layer of concrete and said second carbon fiber grid is substantially embedded in said interior layer of concrete.

19. The composite building panel of claim 14, further comprising a cladding material positioned substantially adjacent to said exterior layer of concrete.

20. A method for manufacturing a composite, carbon reinforced building panel, comprising the steps of:

providing an insulative core having an interior surface and an exterior surface;

positioning a plurality of carbon fiber strands which extend between said interior surface and said exterior surface of said insulative core and which are oriented in a substantially diagonal direction with respect to a longitudinal plane of said insulative core;

positioning a first carbon fiber grid adjacent to said interior surface of said insulative core;

positioning a second carbon fiber grid adjacent to said exterior surface of said insulative core;

interconnecting said plurality of carbon fiber strands to said first carbon fiber grid and said second carbon fiber grid;

pouring an interior layer of concrete adjacent said interior surface of said insulative core;

pouring an exterior layer of concrete adjacent said exterior surface of said insulative core;

curing said interior layer of concrete and said exterior layer of concrete, wherein said insulative core, said plurality of carbon fiber strands, said first carbon fiber grid and said second carbon fiber grid are integrally interconnected.

21. The method of claim 20, further comprising the step of positioning a plurality of compression pins in said insulative core, wherein a compressive strength of said composite, carbon reinforced building panel is enhanced.

22. The method of claim 20, comprising the step of positioning a vapor barrier adjacent to said exterior surface of said insulative core.

23. The method of claim 20, further comprising the step of interconnecting a cladding material to said exterior layer of concrete.

24. The method of claim 20, further comprising the step of positioning a utility conduit at least partially in said insulative core which is adapted to receive at least one utility line.

25. The method of claim 20, wherein said plurality of carbon fiber strands are operably interconnected at a plurality of intersection points.

* * * * *